US006892966B2

(12) United States Patent
Keim

(10) Patent No.: US 6,892,966 B2
(45) Date of Patent: May 17, 2005

(54) FUEL INJECTION AND METHOD FOR OPERATING A FUEL INJECTION VALVE

(75) Inventor: Norbert Keim, Loechgau (DE)

(73) Assignee: Robert Bosch GmbH, Stuttgart (DE)

( * ) Notice: Subject to any disclaimer, the term of this patent is extended or adjusted under 35 U.S.C. 154(b) by 242 days.

(21) Appl. No.: 10/110,248

(22) PCT Filed: Aug. 8, 2001

(86) PCT No.: PCT/DE01/03026

§ 371 (c)(1),
(2), (4) Date: Jul. 24, 2002

(87) PCT Pub. No.: WO02/12714

PCT Pub. Date: Feb. 14, 2002

(65) Prior Publication Data

US 2003/0029941 A1 Feb. 13, 2003

(30) Foreign Application Priority Data

Aug. 10, 2000 (DE) ..... 100 39 080

(51) Int. Cl.[7] ..... F02M 59/00; F02M 39/00; B05B 1/30

(52) U.S. Cl. ..... 239/533.2; 239/533.3; 239/585.1; 239/585.3; 239/585.5; 239/88

(58) Field of Search ..... 239/533.2, 533.3, 239/533.7, 533.9, 585.1–585.5, 88–93; 251/129.21, 129.15

(56) References Cited

U.S. PATENT DOCUMENTS

| | | | | | |
|---|---|---|---|---|---|
| 4,655,255 | A | * | 4/1987 | Rode | 137/627.5 |
| 4,800,862 | A | * | 1/1989 | McKay et al. | 123/531 |
| 4,972,996 | A | * | 11/1990 | Cerny | 239/585.4 |
| 5,353,991 | A | * | 10/1994 | De Nagel et al. | 239/409 |
| 5,979,786 | A | * | 11/1999 | Longman et al. | 239/5 |
| 5,984,210 | A | | 11/1999 | Forck et al. | |

FOREIGN PATENT DOCUMENTS

| | | |
|---|---|---|
| DE | 33 14 899 | 10/1984 |
| DE | 198 55 547 | 6/2000 |

* cited by examiner

*Primary Examiner*—Davis Hwu
(74) *Attorney, Agent, or Firm*—Kenyon & Kenyon

(57) ABSTRACT

A fuel injector, e.g., for fuel injection systems of internal combustion engines, for direct injection of fuel into the combustion chamber of an internal combustion engine. The fuel injector includes a solenoid, an armature, which is acted upon in a closing direction by a restoring spring, and a valve needle, which is linked in a force-locking manner to the armature, for actuating of a valve-closure member, which together with a valve-seat surface forms a sealing seat. The armature includes a first armature part and a second armature part, the restoring spring is supported on the first armature part and the second armature part is linked in a force-locked manner to the valve needle. The valve needle is acted upon in the closing direction by the restoring spring via the first armature part and the second armature part so that the valve-closure member is held in a sealing position on the valve-seat surface.

9 Claims, 1 Drawing Sheet

FUEL INJECTION AND METHOD FOR OPERATING A FUEL INJECTION VALVE

FIELD OF THE INVENTION

The present invention relates to a fuel injector.

BACKGROUND INFORMATION

German Published Patent Application No. 33 14 899 describes an electromagnetically operable fuel injector in which an armature cooperates with an electrically energizable solenoid for electromagnetic operation, and the lift of the armature is transmitted via a valve needle to a valve-closure member. The valve-closure member cooperates with a valve-seat surface to form a sealing seat. The armature is not rigidly attached to the valve needle, but instead is situated on it so it is axially movable. A first restoring spring acts upon the valve needle in the closing direction and thus keeps the fuel injector closed when the solenoid is currentless and not energized. The armature is acted upon by a second restoring spring in the direction of lift so that in the resting position, the armature is in contact with a first stop provided on the valve needle. On energization of the solenoid, the armature is moved in the direction of lift and entrains the valve needle beyond the first stop. When the current energizing the solenoid is switched off, the valve needle is accelerated into its closed position by the first restoring spring and entrains the armature past the stop described above. As soon as the valve-closure member strikes the valve seat, the closing movement of the valve needle is terminated abruptly. The movement of the armature that is not rigidly connected-to the valve needle is continued in the direction opposite the direction of lift and is absorbed by the second restoring spring, i.e., the armature swings back against the second restoring spring which has a much lower spring constant than the first restoring spring. The second restoring spring finally accelerates the armature again in the direction of lift.

When the armature strikes the stop on the valve needle, it may result in a renewed brief lifting of the valve-closure member connected to the valve needle from the valve seat and thus to brief opening of the fuel injector. Debouncing in the fuel injector referred to in German Published Patent Application No. 33 14 899 is therefore incomplete. Furthermore, a disadvantage of the conventional fuel injector in which the armature is rigidly connected to the valve needle, as well as with the fuel injector referred to in German Published Patent Application No. 33 14 899 is that the opening lift of the valve needle begins immediately as soon as the magnetic force exerted by the solenoid on the armature exceeds the sum of the forces acting in the closing direction, i.e., the spring closing force exerted by the first restoring spring plus the hydraulic forces of the fuel under pressure. This is a disadvantage inasmuch when the current energizing the solenoid is turned on, the magnetic force has not yet reached its final value because of the self-induction of the solenoid and the resulting eddy currents. The valve needle and the valve-closure member are therefore accelerated by a reduced force at the beginning of the opening lift. This results in an opening time which is not satisfactory for all applications.

In the closing movement, the conventional one-part armature adheres to the magnetized internal pole for a relatively long time and is released only after a relatively long time due to the residual magnetization. This results in relatively long closing times.

SUMMARY

The fuel injector according to the present invention and the method according to the present invention for operating a fuel injector may provide the advantage that the opening and closing times of the fuel injector achieved by the two-part armature are reduced, which results in a greater accuracy in metering the fuel.

The restoring spring is supported directly on the first armature part and the valve needle is welded to the second armature part, this configuration may be simple and inexpensive to manufacture.

The two adjacent sides of the first and second armature parts are slightly wedge-shaped, thus preventing hydraulic adhesion and further accelerating the opening operation.

Through suitably dimensioned fuel channels in the two armature parts, an unhindered flow of fuel to the sealing seat is guaranteed and a slight hydraulic back-pressure may develop over the armature parts; this does not have a significant influence on the opening movement but it does support the closing movement.

Premagnetization of the solenoid and the first armature part is initiated during the exhaust cycle of the internal combustion engine, during which the combustion chamber pressure drops on the one hand while on the other hand enough time is available to prepare for the next injection operation.

An example embodiment of the present invention is illustrated in simplified form in the drawing and explained in greater detail in the following description.

DETAILED DESCRIPTION

Figure 1:
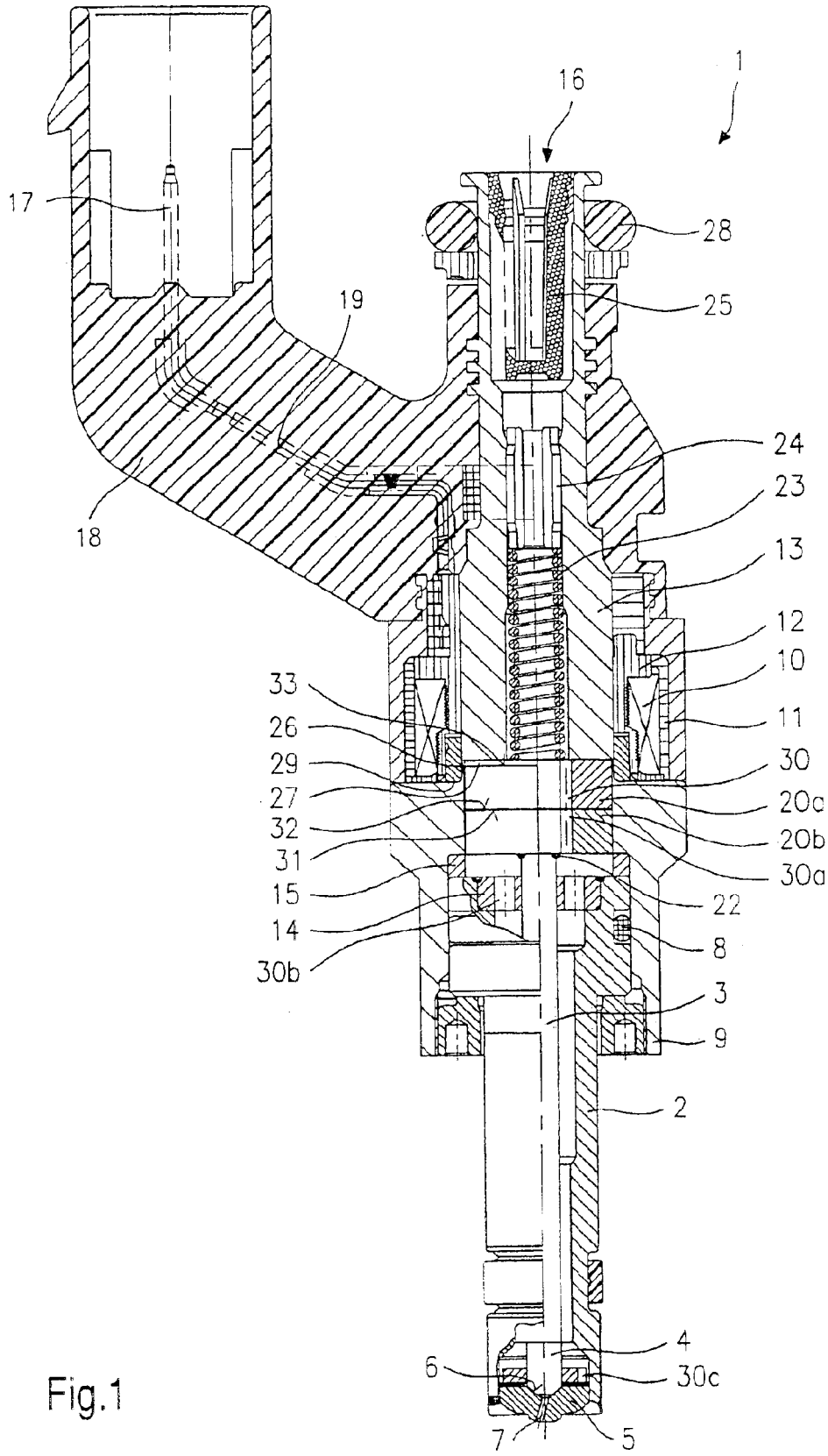
FIG. 1 illustrates a longitudinal schematic view through an example embodiment of a fuel injector according to the present invention.

FIG. 1 illustrates a sectional diagram of an example embodiment of a fuel injector 1 according to the present invention for implementing the method according to the present invention for direct injection of fuel.

Fuel injector 1 is configured in the form of a fuel injector for fuel injection systems of internal combustion engines having compression of a fuel mixture with spark ignition. Fuel injector 1 is suitable for direct injection of fuel into a combustion chamber of an internal combustion engine.

Fuel injector 1 includes a nozzle body 2 in which a valve needle 3 is situated. Valve needle 3 is mechanically linked to a valve-closure member 4 which cooperates with a valve-seat surface 6 situated on a valve seat body 4 to form a sealing seat. Fuel injector 1 in this example embodiment is an inwardly opening fuel injector 1 including an injection orifice 7. Nozzle body 2 is sealed by a gasket 8 against stationary pole 9 of a solenoid 10. Solenoid 10 is encapsulated in a coil housing 11 and is wound onto a field spool 12 which rests on an internal pole 13 of solenoid 10. Internal pole 13 and stationary pole 9 are separated by a gap 26 and are supported on a connecting component 29. Solenoid 10 is energized by an electric current supplied via an electric plug-in contact 17 via a line 19. Plug-in contact 17 is encased in a plastic sheathing 18, which may be integrally molded on internal pole 13.

Valve needle 3 is guided in a valve needle guide 14 which is configured as a disk. A matching adjusting disk 15 is used to adjust the lift.

A two-part armature 20 is situated on the other side of adjusting disk 15. It is divided into a first armature part 20*a* and a second armature part 20*b*. Second armature part 20*b* is connected to valve needle 3 in a frictionally engaged manner via a weld 22. A restoring spring 23, is pre-tensioned by a sleeve 24 in the present configuration of fuel injector 1, and is supported on first armature part 20*a*.

Fuel channels 30*a* through 30*c*, which carry fuel that is supplied via a central fuel feed 16 and is filtered through a filter element 25, to injection orifice 7, run in valve needle guide 14, in armature parts 20*a* and 20*b* and on valve seat body 5. Fuel injector 1 is sealed from a fuel distributor line by a gasket 28.

In the resting state of fuel injector 1, first armature part 20*a* is acted upon by restoring spring 23 against its direction of lift, so that it rests on second armature part 20*b* and thus acts on valve needle 3 so that valve-closure member 4 is held on valve seat 6 in a sealing position. When solenoid 10 is energized, a magnetic field is built up from the inside to the outside, moving first armature part 20*a* in the direction of lift against the spring force of restoring spring 23, the lift is predetermined by a working gap 27 between internal pole 13 and first armature part 20*a* in the resting position.

In this phase of premagnetization, fuel injector 1 still remains closed because the pressure of the fuel flowing through fuel injector 1 on an inlet side 32 of second armature part 20*b* is still sufficiently high to press valve needle 3 into the sealing seat and thus keep fuel injector 1 closed. The premagnetization phase is already initiated during the exhaust cycle of the internal combustion engine, because in this phase, no high pressure prevails in the combustion chamber, and therefore fuel injector 1 remains closed due to the back-pressure of the fuel, even when first armature part 20*a* has already been picked up.

The radial symmetric wedge shape of inlet side 32 of second armature part 20*b*, as well as an injection side 31 of first armature part 20*a* guarantees that second armature part 20*b* will not adhere hydraulically on first armature part 20*a* and thus is picked up prematurely in the direction of lift.

In the second stage of the opening phase during which pressure is built up in the combustion chamber again, solenoid 10 is energized with a higher current, so that the magnetic field also expands in second armature part 20*b* and pulls it in the direction of lift toward first armature part 20*a*, against the hydraulic closing force which acts on inlet end face 32 of second armature part 20*b*. Therefore, valve needle 3, which is welded to second armature part 20*b* is also entrained in the direction of lift, so that valve-closure member 4 is lifted up from valve-seat surface 6, and the fuel carried to injection orifice 7 via fuel channels 30*a* through 30*c* is injected through injection orifice 7.

The movement of valve needle 3 may occur very rapidly in this phase of opening, because only second armature part 20*b* is accelerated, and in addition, only the hydraulic closing force need be overcome.

When the current energizing solenoid 10 is switched off, after the magnetic field has subsided sufficiently, first armature part 20*a* drops away from internal pole 13 due to the force of restoring spring 23 and the hydraulic closing force which acts in the same direction, so that second armature part 20*b* and valve needle 3 are also moved against the direction of lift. Therefore, valve-closure member 4 sits on valve-seat surface 6 and fuel injector 1 is closed.

If fuel injector 1 is closed again after the injection operation, the sum of the elastic force of restoring spring 23 and the hydraulic back-pressure of fuel during the compression and combustion cycles of internal combustion engine 1 is again high enough to seal fuel injector 1 against the combustion chamber pressure. During the exhaust cycle, in which the combustion chamber pressure drops, it may be possible to begin again with premagnetization in preparation for the next injection operation without the longer premagnetization having a negative effect on the opening time of fuel injector 1.

The present invention is not limited to the example embodiment presented here and is also suitable for outwardly opening fuel injectors, for example.

What is claimed is:

1. A fuel injector for a fuel injection system of an internal combustion engine, comprising:

a solenoid;

a restoring spring;

a valve-closure member;

a valve-seat surface;

an armature including a first armature part supporting the restoring spring, and a second armature part axially moveable with respect to the first armature part, the armature being acted upon in a closing direction by the restoring spring; and a valve needle linked in a force-locked manner to the armature for actuating a valve closure member, the valve-closure member together with the valve-seat surface forming a sealing seat, the valve needle being acted upon in the closing direction by the restoring spring via the first armature part and the second armature part so that the valve-closure member is held in a sealing position on the valve-seat surface when the solenoid is not energized;

wherein the first armature part and the second armature part each have at least one fuel channel.

2. The fuel injector according to claim 1, wherein the fuel injector is for direct injection of the fuel into a combustion chamber of the internal combustion engine.

3. The fuel injector according to claim 1, wherein the restoring spring is supported on an inlet side of the first armature part.

4. The fuel injector according to claim 1, wherein the valve needle is fixedly connected to the second armature part.

5. The fuel injector according to claim 1, wherein an injection side of the first armature part rests on an inlet side of the second armature part.

6. The fuel injector according to claim 5, wherein the injection side of the first armature part and an inlet side of the second armature part each have a wedge-shaped surface having radial symmetry.

7. A method of operating a fuel injector for a fuel injection system of an internal combustion engine, comprising:

providing a fuel injector, the fuel injector including;

a solenoid;

a restoring spring;

a valve-closure member;

a valve-seat surface;

an armature including a first armature part supporting the restoring spring, and a second armature part axially moveable with respect to the first armature part, the armature being acted upon in a closing direction by the restoring spring;

a valve needle linked in a force-locked manner to the armature for actuating a valve closure member, the valve-closure member together with the valve-seat surface forming a sealing seat, the valve needle being acted upon in the closing direction by the restoring spring via the first armature part and the second armature part so that the valve-closure member is held in a sealing position on the valve-seat surface when the solenoid is not energized;

energizing the solenoid using an electric current having a first amperage so that the first armature part is pulled up;

energizing the solenoid using an electric current having a second amperage greater than the first amperage so that the second armature part is pulled up; and switching off the current energizing the solenoid.

8. The method according to claim 7, where the providing the fuel injector for direct injection of fuel into a combustion chamber of the internal combustion engine.

9. The method according to claim 7, further comprising:

energizing the solenoid, using the first amperage, during an exhaust stroke of the internal combustion engine.

* * * * *

UNITED STATES PATENT AND TRADEMARK OFFICE

CERTIFICATE OF CORRECTION

PATENT NO. : 6,892,966 B2
DATED : May 17, 2005
INVENTOR(S) : Norbert Keim

It is certified that error appears in the above-identified patent and that said Letters Patent is hereby corrected as shown below:

Column 6,
Lines 2-3, change "where the providing the fuel injector" to -- where the providing step includes providing the fuel injector --.

Signed and Sealed this

Eighteenth Day of October, 2005

JON W. DUDAS
*Director of the United States Patent and Trademark Office*